United States Patent [19]

Schminke

[11] Patent Number: 4,860,763

[45] Date of Patent: Aug. 29, 1989

[54] CARDIOVASCULAR CONDITIONING AND THERAPEUTIC SYSTEM

[76] Inventor: Kevin L. Schminke, 224-10th Ave. North, Fort Dodge, Iowa 50501

[21] Appl. No.: 78,898

[22] Filed: Jul. 29, 1987

[51] Int. Cl.[4] ..... A61B 5/04

[52] U.S. Cl. ..... 128/707; 128/904

[58] Field of Search ..... 128/707, 25 R, 696, 128/706, 904; 272/69, 129

[56] References Cited

U.S. PATENT DOCUMENTS

| | | | |
|---|---|---|---|
| 3,395,698 | 8/1968 | Morehouse | 128/707 |
| 3,518,985 | 7/1970 | Quinton | 128/707 |
| 3,675,640 | 7/1972 | Gatts | 272/69 |
| 3,802,698 | 4/1974 | Burian et al. | 128/707 |
| 3,845,756 | 11/1974 | Olsson | 128/707 |
| 4,278,095 | 7/1981 | Lapeyre | 128/707 |
| 4,409,985 | 10/1983 | Sidorenko et al. | 128/707 |
| 4,708,337 | 11/1987 | Shyu | 272/69 |
| 4,735,410 | 4/1988 | Nobuta | 272/129 |

*Primary Examiner*—Francis Jaworski
*Assistant Examiner*—George Manuel
*Attorney, Agent, or Firm*—Zarley, McKee, Thomte, Voorhees & Sease

[57] ABSTRACT

A cardiovascular conditioning and therapeutic system which utilizes a mechanized powered exercise device for presenting a variable exercise work load to a user which in turn causes a corresponding variation in heart rate of the user. A heart rate transducer is operatively connected to the user, and an exercise work load transducer is operatively connected to the exercise device. A target heart rate for cardiovascular conditioning and therapy is determined, as is a conditioning period. The exercise device is actuated and incrementally increases work load until the user's heart rate comes within a predetermined margin of the heart rate. A control circuitry continuously monitors current heart rate and compares it with the target heart rate. Once current heart rate enters the predetermined margin around the target heart rate, the conditioning period begins. Work load is increased, decreased, or maintained to in turn maintain current heart rate within the predetermined margin of the target heart rate for the conditioning period. The control circuitry repetitively maintains this condition until the end of the conditioning period, when work load is incrementally decreased until heart rate decreases to a preselected level.

14 Claims, 4 Drawing Sheets

CARDIOVASCULAR CONDITIONING AND THERAPEUTIC SYSTEM

BACKGROUND OF THE INVENTION

1. Field of the Invention

The present invention relates to a cardiovascular conditioning and therapeutic system, and in particular, a means and method for presenting a mechanized, continuously monitoring conditioning and therapeutic system which does not allow heart rate to exceed a predetermined target heart rate.

2. Problems in the Art

Significant advances are being made in cardiovascular health care. These improvements have touched upon most areas of prevention, treatment and rehabilitation.

However, cardiovascular health problems remain a leading health concern in the United States. Substantial amounts of medical effort and resources are expended in battling these problems. Significant resources are spent in rehabilitating and conditioning persons which are being treated or have had operations regarding cardiovascular difficulties.

Traditional methods of rehabilitation include testing cardiovascular fitness by measuring heart rate, and by other tests, and then prescribing a regimen of exercise. Generally, this exercise is done under medical supervision, and it is prescribed to be repeated by cardiac rehabilitation sessions over regular intervals, such as day-to-day, every other day, etc.

Such methods require multiple medical personnel, equipment, and time, which further requires communication between personnel to insure the proper rehabilitation program is being pursued. Also, great reliance is placed upon medical personnel to supervise and marshal the patient or user during the conditioning and rehabilitation sessions to make sure that maximum benefit is being obtained by strict compliance to the programs. Additionally, over the long term, it is difficult for the user to translate these conditioning and rehabilitation program situations where there is less supervision, such as home use.

Because of these problems and insufficiencies, attempts have been made to create conditioning and rehabilitation systems which allow medical personnel or the user to monitor their performance, and select the level of work load desired during the conditioning period. Some of these systems utilize transducers to monitor heart rate, and also monitor the work load to automatically cause the exercise device to make the user work to the point of achieving a selected heart rate.

However, many of these systems are cumbersome in that they are applicable only to a certain type of exercise device or are not flexible in their applications.

Additionally, problems exist in the coordination of having the exercise device operate to present the work load to the user in a controllable and safe manner. For example, present devices which have to cause the user to reach a target heart rate without a carefully defined and controlled start-up for safe and gradually increased presentation of work load probably would be dangerous for users such as cardiac patients. Additionally, without careful and safe control of the level of work load and heart rate in the conditioning stage, the system again may be very dangerous. Inherent control in the present application additionally solves one of the major problems in uses such as cardiac rehabilitation. The safety and control of the present invention deters under-exercise by a timid or frightened patient which may delay recovery or limit the level of recovery. It would allow the timid patient to gain self-confidence in a safe manner. In contrast, the present invention would regulate the over aggressive patient and prevent over-exertion which obviously would be very dangerous. The over aggressive patient could then exercise without the fear of dangerous consequences.

Additionally, there are problems in the art in achieving a safe conclusion to conditioning or rehabilitation. The present invention operates automatically to present a warm-down period which regulates the user's cardiovascular system to return to more normal parameters before the exercise is completed, thereby allowing a safer and potentially more beneficial exercise cycle.

It is therefore a primary object of the present invention to present a system as above described which solves the problems or improves over the deficiencies in the art.

A further object of the present invention is to provide a system as above described which presents a controlled and variable workd load to a user while at the same time monitors heart rate, compares it to target heart rate, and maintains the user's heart rate at or near the target heart rate.

Another object of the present invention is to provide a system as above described which continuously monitors the user's heart rate and prevents it from exceeding a predetermined target heart rate.

Another object of the present invention is to provide a system as above described which can be applied to a variety of type of exercise devices.

A further object of the present invention is to provide a system as above described which can easily and flexibly be customized for individual users.

Another object of the present invention is to provide a system as above described which insures safe workout conditions for a user.

Another object of the present invention is to provide a system as above described which can be operated from a given site, or can be operated according to instructions received from a remote location.

Another object of the present invention is to provide a system as above described which utilizes continuous feedback in its operation, and optionally allows the user or supervising personnel to have the continuous visual representation of parameters and readings relevant to the system.

A further object of the present invention is to provide a system as above described which provides control and safety so that a user will be assured of proper exercise and conditioning.

Another object of the present invention is to provide a system as above described which is easy to operate, is efficient, and is economical and reliable.

These and other objects, features and advantages of the invention will become more apparent with reference to the accompanying specification and claims.

SUMMARY OF THE INVENTION

The present invention includes a means and method of cardiovascular conditioning and therapy for rehabilitation. The means and method are achieved by utilizing a mechanized self-powered exercise means which can create and present to a user a variable exercise work load. By utilizing the exercise means, the user therefore can in turn cause a corresponding variation in the user's heart rate.

The user's heart rate is monitored by a transducer device and the work load is monitored by an appropriate transducer device. Therefore, the system continuously is able to know the heart rate of the user and the corresponding work level being produced by the exercise means.

A desired target heart rate is determined for each user. This target rate is selected according to the conditioning and therapeutic needs of the particular user and is introduced to the system through an input means. Likewise, the predetermined period of time for the conditioning and therapeutic workout is selected and input into the system through the input means.

A control means receives the input information from the input means and the information from the transducer means. Upon instruction from the user or medical personnel, the control means actuates the exercise means and incrementally increases the work load during a warm-up period. The control means continuously monitors heart rate to insure that the target rate is not exceeded. The work load is increased until the user's heart rate enters a predetermined range at or around the target heart rate. At that point, the control means begins timing of the workout period, and controls the work load to cause the user's heart rate to stay within the range around the target heart rate. If the heart rate falls below the target rate, the control means sends a signal to the exercise means to increase the work load incrementally until the user's heart rate is brought back into the target range. Conversely, if at any time the user's heart rate exceeds the target range, control means instructs the exercise means to decrease the work level until the heart rate is brought back within the range.

After the conditioning period is done, the control means reduces the work load to a predetermined level for a predetermined time and then terminates the presentation of the work load to the user.

Alternatively, the control means could incrementally decrease the work load until the user's heart rate is reduced to a predetermined level.

The invention can take on different embodiments. The first embodiment includes a conventional exercise means having appropriate transducer means to send information regarding the work level of the exercise means to a control means which is separated from the exercise means, and is removable and portable therefrom.

The second embodiment incorporates all elements into the housing or framework of the exercise means so that it can all be incorporated into one unit. A third embodiment includes the exercise means and transducers at the user's exercise location, but enables the control means to be at a remote location and communicate with the exercise means and transducers via communications lines.

DETAILED DESCRIPTION OF THE PREFERRED EMBODIMENT

With reference to the drawings, specific embodiments of the present invention will now be described in detail. It is to be understood that the invention can take many forms and embodiments, and that those described below are by way of example only, and are not intended to limit or otherwise diminish the scope of the invention.

Figure 1:
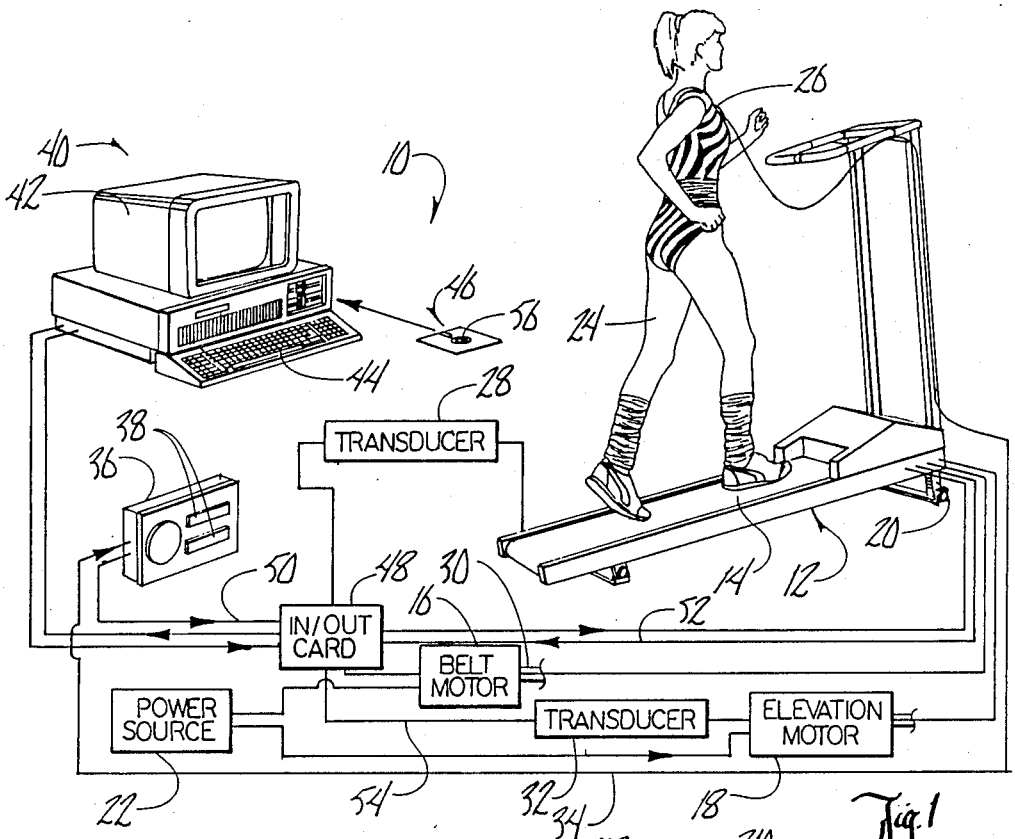
FIG. 1 is a partial perspective and partial schematic view of one embodiment according to the present invention.

With particular reference to FIG. 1, a first embodiment of a cardiovascular conditioning and therapeutic system 10 is depicted. A conventional mechanized, self-powered treadmill 12 has a variable speed belt 14, operated by belt motor 16. Additionally, the elevation or angular orientation of belt 14 with horizontal can be variably changed by operation of elevation motor 18 which is operatively connected to front treadmill legs 20. Treadmill 12 is connected to a conventional power source 22 and functions as is known in the art. Treadmill 12 can be a Burdick treadmill, Model TMS 100.

Treadmill 12 presents a variable work load to a user 24. The work load can be at a "0" level when belt 14 is stationary; and can be incrementally increased by beginning movement of belt 14, increasing the speed of belt 14, and/or increasing the angular orientation of horizontal of belt 14 by means of elevation motor 18 and extendable treadmill legs 20.

A heart rate transducer 26 is operatively positioned on user 24. Such heart rate transducers are well known in the art, and can take the form of an electrode, a pulse monitor, or any other device which picks up the user's heart rate and transforms that heart rate into a corresponding signal.

A belt speed sensor or transducer 28 is operatively connected to drive shaft 30 of belt motor 16 and senses each revolution of drive shaft 30 converting the same into a corresponding signal. Similarly, elevation motor transducer 32 is operatively connected to elevation motor 18, however, transducer 32 operates to sense the length of time elevation motor 18 operates and produces a signal corresponding to this length of time.

The signal from the heart rate transducer 26 is communicated by cable 34 to a monitoring device 36. Monitoring device 36 converts the heart rate transducer 26 signal to a numerical heart rate value which can be visually presented on display 38. In the embodiment of FIG. 1, monitoring device 36 can be an Avionics Stress Test Monitor Model 2900B. The control means for the embodiment of FIG. 1 is computer 40, including display monitor 42, keyboard 44, software 46, and input/output (I/O) card 48. I/O card 48 serves as an interface between computer 40 and the other components of the system. The signals from heart rate transducer 26 through monitoring device 36, belt speed transducer 28, and elevation motor transducer 32 are communicated with I/O card 48 by cables 50, 52 and 54, respectively. I/O card 48 therefore allows computer 40 to receive information on the user's heart rate, treadmill belt speed, and elevation of the treadmill belt in a form usable by computer 40.

In the embodiment of FIG. 1, computer 40 can be an Apple IIe Model computer with at least one floppy disk drive. I/O card 48 is operatively insertable in an expansion slot of computer 40, such as is known in the art.

Floppy disk 56 contains the software programming for the system of FIG. 1. By inserting disk 56 into computer 40, and accessing its programming, the system can be started. Heart rate transducer 26 must be operatively positioned upon user 24. All power connections for treadmill 12 and computer 40 need to be made. The programming will then request the user 24 to enter a predetermined target heart rate, and a length of time user 24 desires to be conditioned. This information is entered through keyboard 44. Again, upon instruction through keyboard 44, belt 14 of treadmill 12 will be slowly started by instruction from computer 40.

Software 46 then instructs belt motor 16 of treadmill 12 to gradually and incrementally increase its speed to "warm-up" user 24. In what is called the "warm-up" period or phase, the heart rate of user 24 will therefore correspondingly incrementally increase towards a conditioning and therapeutic level. Ultimately, belt speed will increase until the user's heart rate reaches a predetermined range at or near the predetermined target heart rate.

The target heart rate for each user is determined by medical principles. It is best that it be determined by health care professionals, but it is to be understood that it will vary from user to user based on age, physical condition, medical criteria, intended therapy purposes and other factors.

During the warm-up period, the user's heart rate is continuously monitored by heart rate transducer 26 and this information is continuously fed to computer 40. Software 46 recursively compares the continuous actual user's heart rate to the pre-entered and predetermined target heart rate. When the user's actual heart rate enters the predetermined range around the target heart rate, software 46 switches to a "conditioning period", phase, or mode.

The conditioning period begins with starting a clock mechanism in computer 40 which will run for the pre-entered time the user or medical personnel entered prior to actuating the treadmill 12. Secondly, software 46 causes computer 40 to monitor the actual heart rate of user 24 and will attempt to maintain the user3 s heart rate within the preset range around the target heart rate for the duration of the conditioning period.

This is accomplished by varying the work load presented by treadmill 12 in accordance with variations in the actual user's heart rate. For example, if actual heart rate drops below the target heart rate range, computer 40 will instruct belt motor 16 to incrementally increase its speed until it senses that heart rate is back within the range. Any increase of belt speed will then be discontinued. If the heart rate exceeds the range around the target heart rate, conversely the belt motor 16 is instructed to slow down the speed of belt 14 until heart rate re-enters the target range.

It is also to be understood that software 46 can be written to include utilizing the elevation of belt 14 of treadmill 12 to assist in varying the work load of treadmill 12. Thus, to maintain the speed of belt 14 at a reasonable rate, and yet present enough work load to elevate a user's heart rate into the conditioning target range, the elevation of belt 14 can be sensed through elevation motor transducer 32, and if more work load is needed, computer 14 can send a signal to elevation motor 18 to raise the angle of elevation of belt 14 incrementally until the user's heart rate enters the target range. Again, conversly, if heart rate exceeds the target range, computer 40 can instruct elevation motor 18 to reduce the angular elevation of belt 14. It is also to be understood that software 46 can function to combine variation of belt speed and angular elevation of belt 14 in any manner to vary the work load of treadmill 12.

In the preferred embodiment, elevation motor transducer 32 consists of an electrical timer which monitors the amount of time elevation motor 18 runs. The computer 40 then calibrates this to the elevation angle of belt 14 to "know" the angle of elevation of belt 14. Alternatively, a transducer which actually senses angle of elevation might be used.

After the timed conditioning period expires, as kept track of by computer 40, software 46 through computer 40 will automatically instruct treadmill 12 to decrease the work load presented to user 24 in a "cool-down" period or phase. The software 46 can automatically decrease the belt speed and/or angle of elevation of treadmill 12 to a predetermined reduced level for a predetermined period (for example three minutes), and then automatically shut off belt 14.

Alternatively, belt speed and/or angle of elevation of treadmill 12 could be be incrementally decreased to reduce the user's heart rate. The heart rate will continue to be monitored, and if it ever exceeds the target rate range, treadmill 12 will be instructed to reduce the work load (presented by belt speed and/or belt angular elevation) as quickly as possible to bring the actual heart rate at least down into the target range. The incremental reduction of work load will continue until the work load presented by the treadmill is minimal. It is to be understood that software 46 could be programmed so that the cool-down period would continue until a predetermined quitting heart rate is reached by user 24, or the cool-down period could simply be timed to continue until belt 14 is automatically stopped.

It is to be understood that at the end of the "cool-down" period, treadmill belt 14 comes to a complete stop, as controlled by computer software 46. Computer 40 and the heart rate monitoring system remain operational and can be used to begin another exercise period, or can be turned off by the user or supervisory personnel.

It can therefore be seen that the embodiment of FIG. 1 allows readily available resources such as conventional treadmills and personal computers to be easily used to accomplish the objects of the invention. The system is also very easy to use, while at the same time continuously monitoring the user's heart rate and automatically acting to protect against overshoot of the target range.

Figure 2:
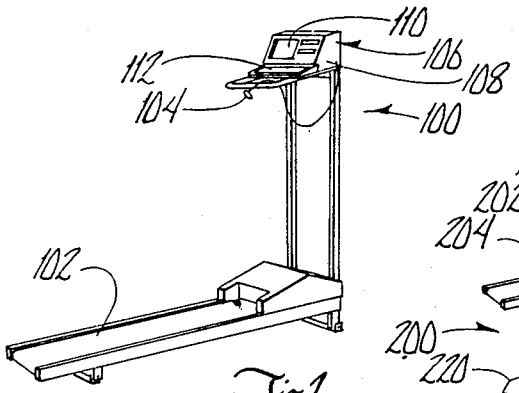
FIG. 2 is a schematic of a second embodiment according to the present invention.

FIG. 2 depicts a second embodiment of the invention, a cardiovascular conditioning and therapeutic system 100. System 100 can function essentially the same as that of FIG.1. However, the components of system 100 are integrated into a treadmill 102 so as to combine the elements into a self-contained unit. Treadmill 102 would function like the treadmill 12 in FIG. 1, having a variable belt speed and elevation angle height by means of corresponding motors. Also, the heart rate monitor 104 would function similarly to that of the heart rate transducer 26 of FIG. 1.

The control unit 106 of the embodiment of FIG. 2, would be a miniaturized microprocessor 108 having a display 110, and an entry or input board 112. Programming similar to that of software 46 of FIG. 1 would be pre-programmed into microprocessor 108. Similar types of input would be allowed and control unit 106 would monitor and control operation of the system similar to that of the embodiment of FIG. 1.

The obvious advantages of the embodiment of FIG. 2 is that it does not require a separate and independent computer which is expensive and can be more difficult to operate. It also enables a unitary device which does not require connections of disparate elements which from time to time can become disconnected or have a greater propensity towards malfunction.

It is also be be understood that the invention could take the form of utilizing a conventinal treadmill and heart rate transducer, but have a control unit consisting entirely of dedicated electronics. Input of target heart rate and length of time of the conditioning period could easily be produced using analog components such as multipositional mechanical switches and mechanical or analog timers. Such as configuration of dedicated electronic elements as well within the skill of those of ordinary skill in the art.

Figure 3:
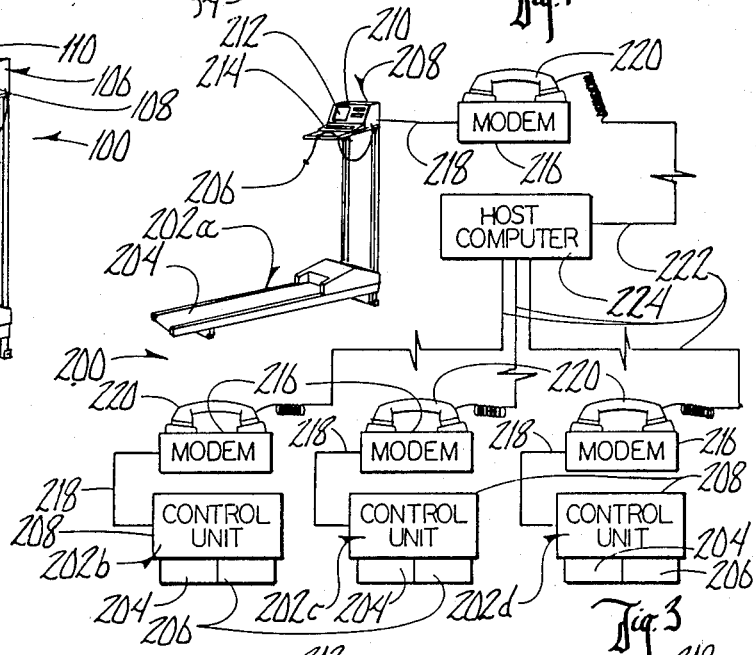
FIG. 3 is a partial perspective and partial schematic of a third embodiment according to the present invention.

FIG. 3 depicts a further embodiment of the present invention. Cardiovascular conditioning and therapeutic system 200 includes a plurality of conditioning stations 202*a*, 202*b*, and 202*d* which each contain a treadmill 204, which is similar to treadmill 102 of FIG. 2, a heart rate transducer 206 which is similar to transducer 104 of FIG. 2, and a control unit 208. Control unit 208 can include a microprocessor 210, a display 212, and an input board 214 similar to that of control unit 106 of FIG. 2.

System 200, additionally includes a modem 216 hooked up to each conditioning station 202 by conduits 218. A telephone 220 adjacent to each moden 216 is then communicable through telephone lines 222 to a remote host computer 224. Host computer 224 can contain software programming which can simultaneously instruct and control the operation of each conditioning statement 202*a–d* for the individual parameters for each user.

Control units 208 at each conditioning station 202 allows the user to input such information as length of conditioning, and target heart rate, or this can be done by supervisory personnel at the host computer 224. System 200 may also require that each user identify themselves and have protection mechanisms so that the users cannot override the prescribed control of each conditioning statement 202*a–d*.

System 200 allows flexibility in that conditioning stations 202*a–d* can be positioned at remote locations, perhaps at the homes of the individual users, whereas host computer 224 can be centralized and operated by a minimum number of supervisory personnel, for example, at a hospital or rehabilitation clinic.

Figure 4:
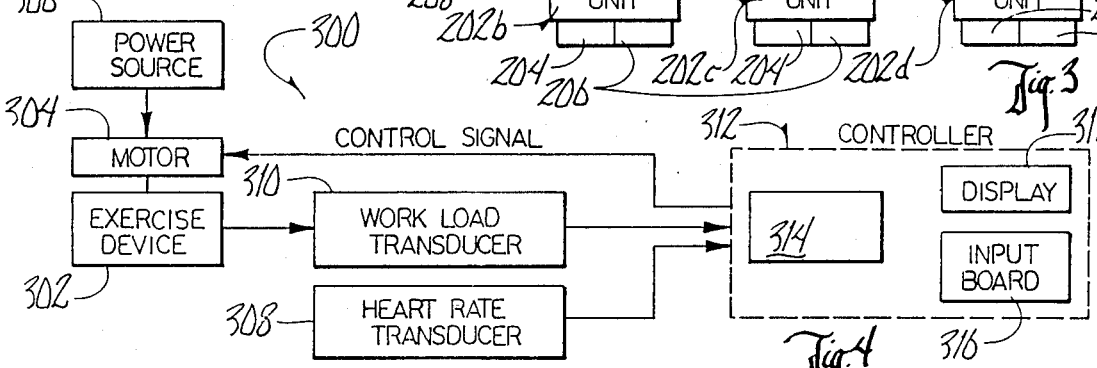
FIG. 4 is a schematic diagram of the primary elements of an embodiment of the present invention.

FIG. 4 shows in block schematic form, the general configuration of the embodiments of the invention. This general configuration will be referred to as system 300.

An exercise device 302 presents a workload by a user by means of motor 304. Examples of an exercise device 302 could be mechanized and self-powered variable work load treadmills, rowing machines, bicycles, and the like. Motor 304 would be operatively connected to a power source 306 such as conventional household current.

A heart rate transducer 308 would be operatively connected to the user. It could consist of an ear clip, fingertip, or chest electrode.

Exercise device or work load transducer 310 similarly would monitor the work load presented by exercise device 302. Transducer 310 can take on many forms such as are available and known in the art.

A controller 312 receives continuous readings from heart rate transducer 308 and exercise device transducer 310. By appropriate software 314 (or by appropriate dedicated electronics), controller 312 receives input through input entry board 316 regarding the particular parameters for each user. Conventionally, these parameters will include the target heart rate for each user, and the length of the conditioning period for each user. Controller 12 would also operatively include a display 318 which allows the user or supervisory personnel to see a continuous and current visual record of the user's heart rate, or other relative parameters of system 300

It will be appreciated that the present invention can take many forms and embodiments. The true essence and spirit of this invention are defined in the appended claims, and it is not intended that the embodiment of the invention presented herein should limit the scope thereof.

It is to be understood, for example, that the system could have an automatic "shut down" for extreme variations in heart rate. It could also monitor arrythmia to recognize dangerous heart rhythms and automatically terminate the exercise program.

There could also be means for the user or supervisory personnel to interrupt or stop the program while it is in progress. One example could be the use of some sort of a switch. For safety purposes, it could be in the form of a "dead man switch" wich would require constant affirmative pressure by the user (perhaps by hand gripping pressure) to maintain operation of the system. If the hand gripping pressure is released, the system could interrupt or stop.

For example, in the embodiments of the invention discussed above, many different types of control circuitry and programming can be utilized to achieve the same results. To aid in a further understanding of the invention, a specific embodiment of the manner in which system 10 of FIG. 1 operates and is controlled will be described.

Appendix A contains software programming operable on an Apple IIe computer for operating the embodiment depicted in FIG. 1. Input/output (I/O) card 48 is designed to facilitate the interfacing of heartrate transducer 26, belt speed transducer 28, elevation motor transducer 32, and monitoring device 36 with computer 40. I/O card 48 must be capable of receiving and sending the necessary signals to enable computer 40 to provide overall control for system 10. It is to be understood that I/O card 48 also facilitates output control from computer 40 back to belt motor 16, and elevation motor 18.

In this embodiment, I/O card 48 contains six different functional circuitry segments namely (1) system time base, (2) treadmill speed feeback, (3) elapsed time accumulator, (4) heart rate monitor input, (5) treadmill motor control, and (6) I/O control logic.

Figure 5:
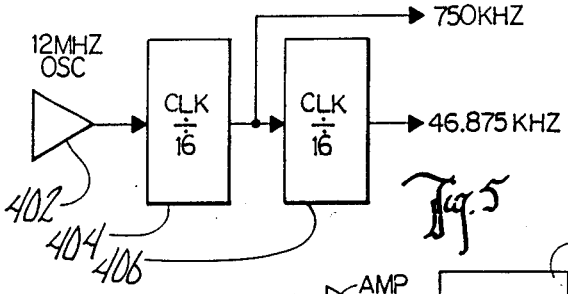
FIGS. 5-13 are schematics of various parts of the control circuitry for an embodiment of the invention.

The system time base for I/O card 48 is depicted by FIG. 5. The system time base includes a 12 megahertz (MHz) crystal controlled oscillator 402 with dual divide by sixteen function producing a 750 kilohertz (Khz) clock 404, and a 46.875 Khz clock 406. Clocks 404 and 406 provide for synchronization of events and a time base to make accurate measurements.

Figure 6:
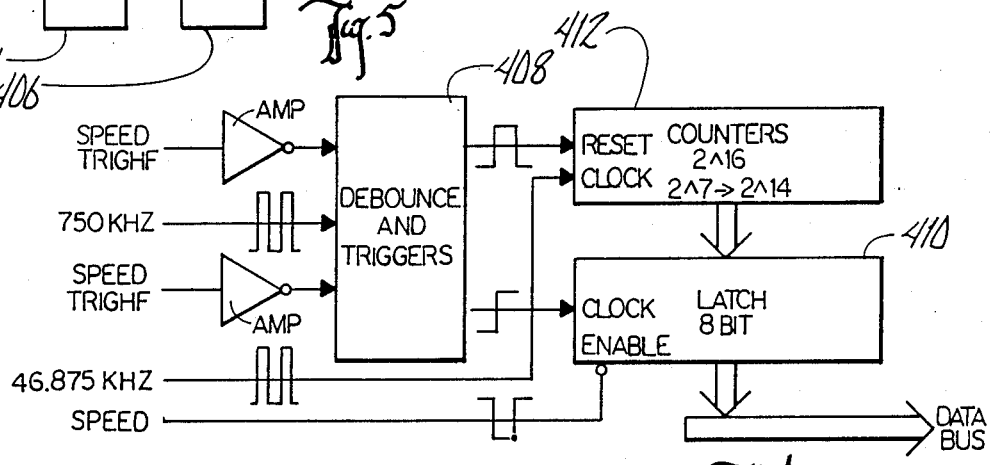
Figure 7:
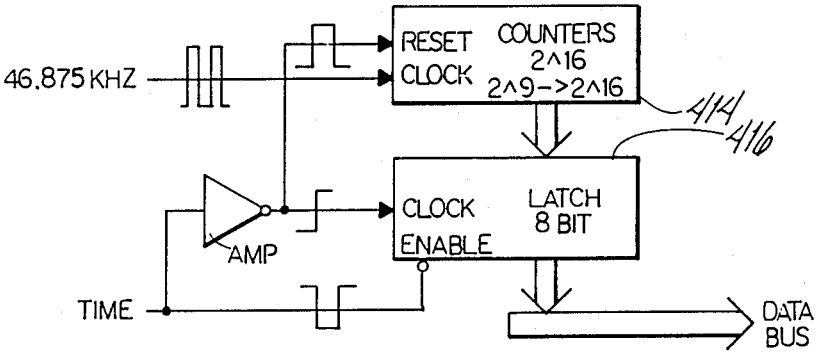

Clocks 404 and 406 are used by the treadmill speed feedback debounce/trigger circuitry and binary counters of FIG. 6. Clock 406 is also used by the elapsed time accumulator of FIG. 7.

The treadmill speed feedback circuitry of I/O card 48 (shown at FIG. 6) provides an accurate measurement of time related to the speed of belt 14 of treadmill 12. Dual pulses from the speed detector (see FIG. 11) are buffered and debounced to form a single pulse utilizing debounce and triggers 208. This single pulse is synchronized using 750 Khz clock 404 to produce a clock pulse to 8 bit latch 410 and a reset pulse to the counter section 412.

Counter section 412 is a 2'16 binary counter that free runs at 46.875 Khz from clock 406. At the time of the speed detected pulse, the current count (bits 2 7 through 2 14) are latched and counter section 412 is reset. Accurate measurements of time are made from detected to detected pulse.

Computer 40 reads this data periodically by activating its speed strobe. A direct conversion of time to speed can be made by using Table 1.

TABLE 1

| COUNT/SPEED CONVERSION | | |
|---|---|---|
| SPEED (mph) | PULSE PERIOD (ms) | LATCHED COUNT (binary) |
| 4 | 85 | 29 |
| 3.5 | 100 | 35 |
| 3 | 120 | 42 |
| 2.5 | 140 | 49 |
| 2 | 180 | 63 |
| 1.5 | 230 | 80 |
| 1 | 350 | 122 |
| 0.5 | 590 | 207 |

presented from heartrate monitor or transducer 26. Latches 418 and 420 buffer and stabilize the data by using the heartrate blanking strobe from the monitor to clock the valid data into latches for 418 and 420. The application's program can read the BCD hundreds data, even using strobe H_RATE 2, or the BCD tens and units data, using strobe H_RATE 1.

Figure 9:
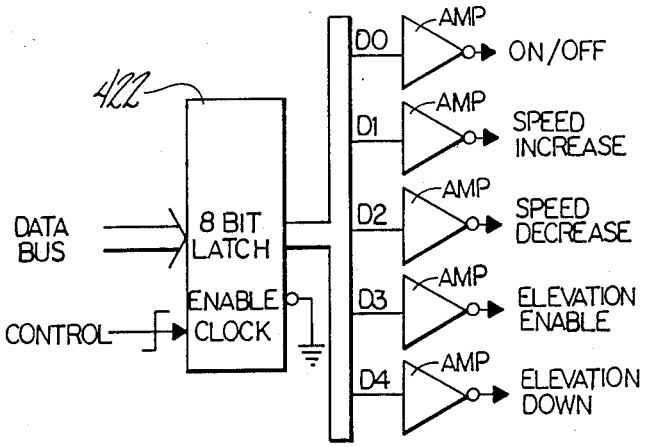

FIG. 9 depicts the treadmill motor control section of I/O card 48 which provides the necessary TTL outputs to enable the various treadmill functions. Data provided by the applications program is latched by latch 422 using the "CONTROL" strobe. This data consists of five bits of information: (1) on/off, (2) speed increase, (3) speed decrease, (4) elevation enable (up), and (5) elevation down. These five bits of information are buffered at TTL logic levels to drive the cable interference to treadmill 12.

Figure 10:
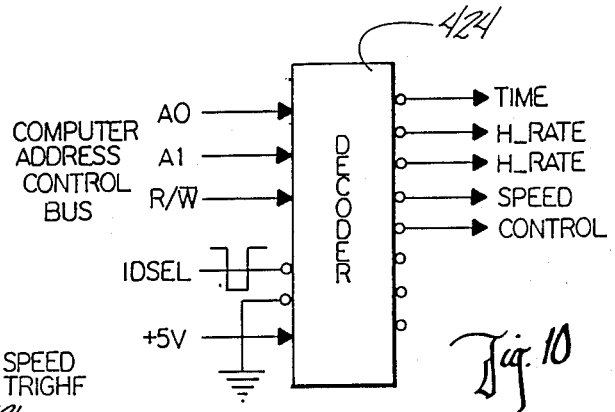

The I/O control logic (FIG. 10) provides the link between the application program and digital I/O card 48. Five strobes are needed to manage the hardware. The five strobes are characterized as:

(1) TIME ($SCOCO) reads accumulated time and resets counter string.

(2) H_RATE2 ($COC1) reads the heartrate BCD hundreds data.

(3) H_RATE1 ($COC2) reads the heartrate BCD tens and units data.

(4) SPEED ($COC3) reads the measured time between speed pulses from the treadmill.

(5) CONTROL ($COC4) writes the control bits to the output latch.

I/O control logic is facilitated by decoder 426. Table 2 sets forth the strobe's bit assignments:

TABLE 2

| | | STROBE'S BIT ASSIGNMENTS | | | |
|---|---|---|---|---|---|
| DATA BUS | TIME (ms) | H_RATE2 (BPM) | H_RATE1 (BPM) | SPEED (ms) | CONTROL |
| b7 | 1400 | X | 80 | 350 | |
| b6 | 700 | X | 40 | | |
| b5 | 350 | X | 20 | 87.4 | |
| b4 | 175 | X | 10 | 43.7 | elevation down |
| b3 | 87.4 | X | 8 | 21.8 | elevation enabled |
| b2 | 43.7 | X | 4 | 10.9 | speed decreased |
| b1 | 21.8 | 200 | 2 | 5.46 | speed increase |
| b0 | 10.9 | 100 | 1 | 2.73 | on/off |

The elapsed time accumulator I/O card 48 is the time base for the application program (see Appendix A) of computer 40. This accumulator is clocked by the 46.875 Khz clock 406 from the system line base (FIG. 5).

Counter 414 is a 2 16 binary counter with the top eight bits being latched by latch 416 into the accumulator. Computer 40 issues its time strobe which latches the current count into the accumulator and at the same time resets the 2 16 binary counter 414. In this manner, every time the application program reads "TIME", a new accumulation is started and the program can keep time of total elapsed time.

The application program does have a requirement to read "TIME" at least once every 1.4 seconds to prevent overflow of counter 414. The least significant bit of the accumulator (2 9) is clocked at 183 hertz which allows a maximum count of 1.4 seconds.

Figure 8:
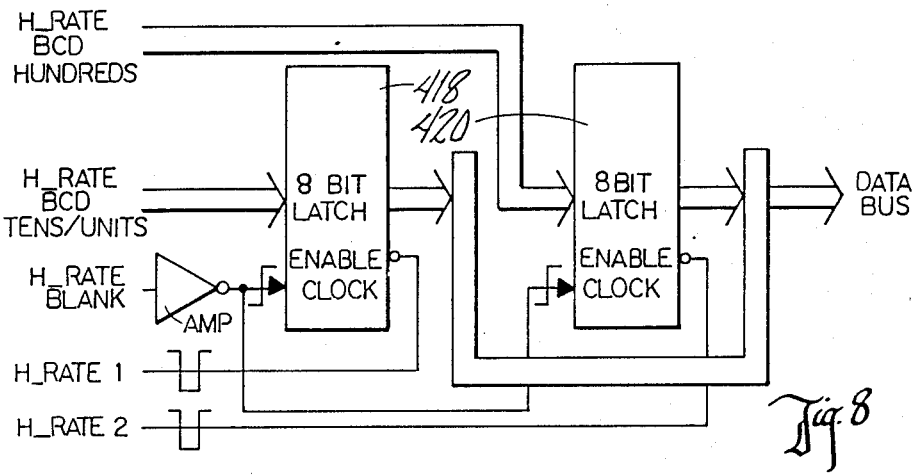

The heartrate monitor input (FIG. 8) consists of a pair of latches 418 and 420 for the BCD encoded data Treadmill 12 is equipped with five manual functions: (1) on/off, (2) speed increase, (3) speed decrease, (4) elevation up, and (5) elevation down. As previously described, a method of detecting the speed of belt 14 was also installed. Treadmill 12 therefore had to be modified to include means for detecting the speed of belt 14, to convert the TTL logic of computer 40 to +12 volt relay logic, and to convert the manual switches of treadmill 12 to computer controlled relay switches.

Figure 11:
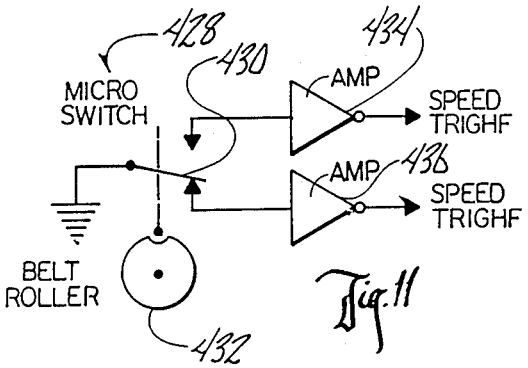

A relatively simple device was employed to detect the speed of moving belt 14 (see FIG. 11). A micro switch 428 was mounted to treadmill 12 with its wiper arm 430 touching the main belt roller 432. Main belt roller 432 was taken drilled in line with micro switch 428 so that contact in switch 428 would be broken at every revolution. Two amplifiers 434, 436 feed the signals from microswitch 428 to I/O card 48 of computer 40. The measured time between pulses can be used to determine belt rotation speed as discussed with respect to the treadmill speed feedback of I/O card 48.

Figure 12:
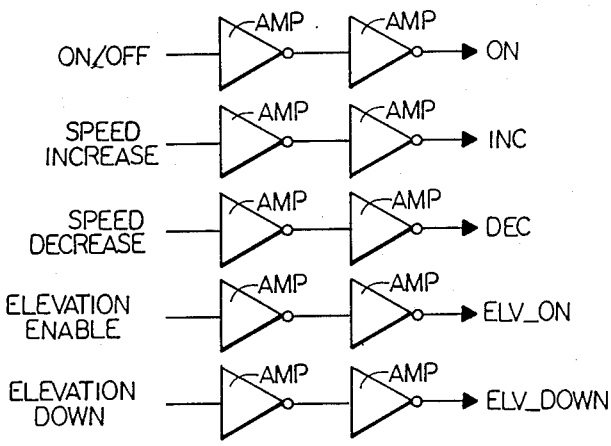

FIG. 12 depicts a configuration of treadmill relay drivers. The treadmill relay drivers provide a buffered/level translation from TTL logic to +12 volt logic used by the relays. For each signal from the I/O card a set of buffers control the applicable relay.

Figure 13:
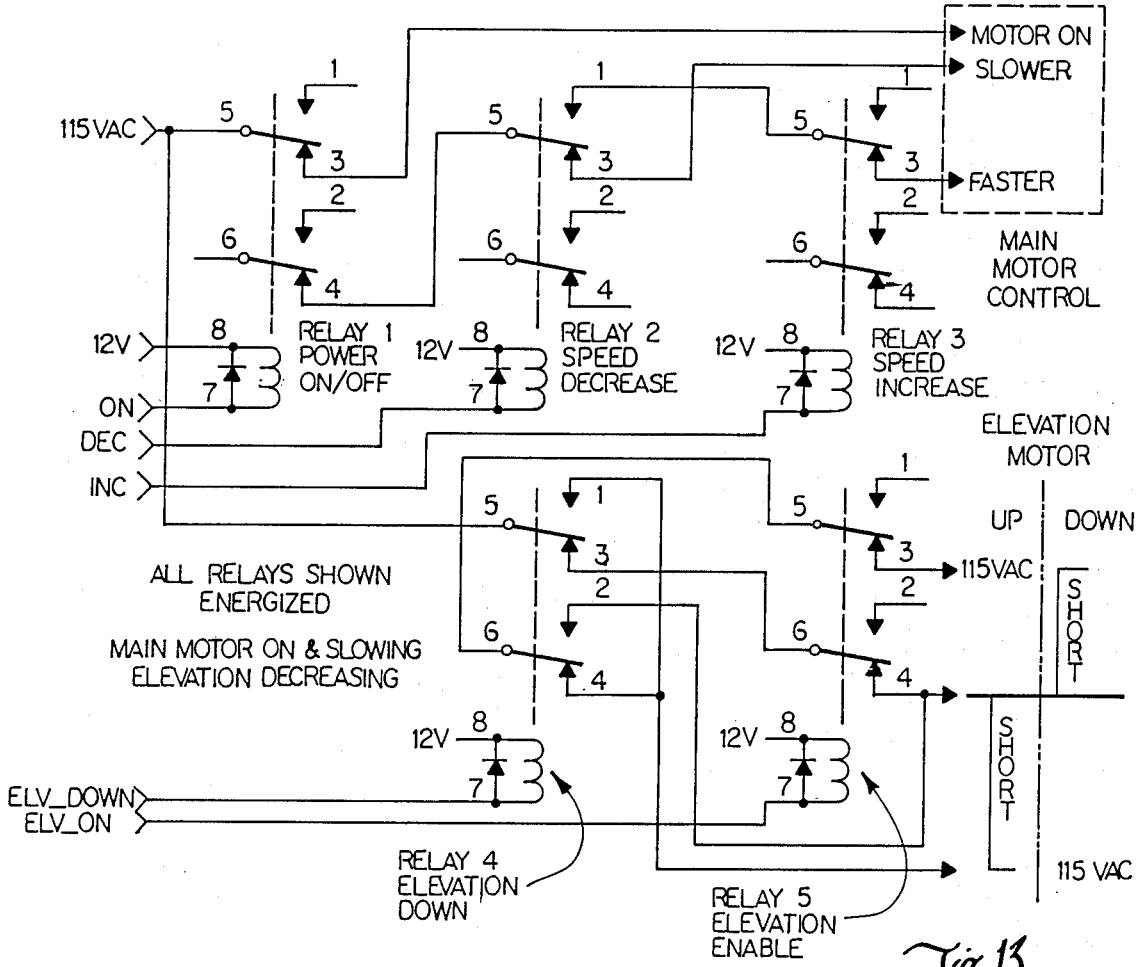

Belt motor 16 and elevational motor 18 of treadmill 12 are controlled by a bank of 115 VAC, 10 amp relays (See FIG. 13) under computer control that act in place of the manual switches of treadmill 12. The relays 1–5 can be activated from the driver outputs of FIG. 12 to produce the desired results, such as speed increase. In almost every case, computer 40 has immediate feedback of any action it takes except for control of elevation of belt 14. In that instance, computer 40 must define a known state, such as "bottom" or "minimum angle", and then elevate belt 14 using predefined time versus elevation measurements. This relates to the timing of operation of elevation motor 18 as previously discussed. The outputs of the relay bank are tied directly to dual motors 16 and 18 of treadmill 12.

For example, in the embodiments of the invention which require software programming, many different programming steps can be used to achieve the same results. However, for purposes of the present invention, the following Appendix A is an example of a program utilized with respect to system 10 of FIG. 1, operable on an Apple IIe computer.

What is claimed is:

1. A programmable cardiac rehabilitation system which allows flexible setting of prescribed exertion level or levels for rehabilitation for a patient, and which requires the patient to reach the prescribed level or levels of exertion and remain in a target range defining the prescribed level or levels of exertion, while at the same time being protected from dangerous or damaging exertion, so that the system automatically prevents both underexertion and overexertion comprising:

a treadmill which is electrically controlled;

a transducer means connected to the patient, said transducer means being in communication with a heart rate monitor whereby the heart rate of said patient is converted to an electrical signal;

a computer system in communication with said monitor and said treadmill;

an input/output card means electrically connected to said treadmill, said monitor, and said computer system, whereby said card means electrically interfaces between said treadmill, monitor, and said computer system and whereby said card means electrically communicates said electrical signal from said monitor to said computer system and allows electrical instructions to be transmitted from said computer system to said treadmill;

a software system loaded into said computer system providing instructions to said computer system, said computer system receiving signals from said monitor and sending signals to said treadmill, said software system providing an exercise program comprising a warm-up period having slow incremental increases in any of the treadmill operational factors in the set comprising elevation and speed of said treadmill, until a pre-selected target heart rate of said patient is achieved, a work period maintaining said target heart rate of said patient for a preselected length of time by controlling the treadmill operational factors and preventing either underexertion and overexertion, and a cool-down period decreasing said heart rate of said patient at slow increments by controlling the treadmill operational factors;

the exercise program having predetermined parameters selected for the particular patient, based on factors such as age, physical condition, medical criteria, and intended exercise purpose, including but not limited to target heart rate and length of work period;

means for recursive comparison of heart rate of the patient and the target heart rate including warm-up, work, and cool-down periods;

clock means for automatic timing of the work period, the clock means beginning timing upon completion of the warm-up period, and upon completion of the work period signalling the beginning of the cool-down period; and automatic shut-down means for monitoring extreme variations in the heart rate of the patient and causing the treadmill to stop.

2. A cardiac rehabilitation system comprising an electrically controlled treadmill; a heart rate transducer means connected to a patient; a heart rate monitor connected to said heart rate transducer means whereby the heart rate of said patient from the heart rate transducer means is converted to an electrical signal; a computer receiving said electrical signal and sending a signal to said electrically controlled treadmill; an input/output card connected to said computer, monitor, and treadmill whereby electrical signals from said monitor are communicated to said computer and instructions from said computer are transmitted to said treadmill and which allows flexible setting of prescribed exertion level or levels for rehabilitation for the patient, and which requires the patient to reach the prescribed level of exertion and remain in a target range defining the prescribed level exertion, while at the same time being protected from dangerous or damaging exertion, so that the system automatically prevents both underexertion and overexertion, the improvement comprising:

a software system for said computer for an exercise program comprising a warm-up period of slow incremental increases in the speed of said treadmill until a preselected target heart rate of said patient is achieved;

a work period consisting of maintaining said heart rate of said patient for a preselected length of time and preventing either underexertion and overexertion;

a cool-down period consisting of decreasing said heart rate of said patient at slow increment;

the software system including verification means for ensuring accuracy of the heart rate received and converted to the electrical signal by the heart rate monitor, and thus ensuring accuracy of control of the patient's heart rate, the verification means including periodic monitoring means of heart rate of the patient, the monitoring means recursively averaging the most recent three periodic heart rates to eliminate random and equipment-caused erroneous heart rate signals which could cause dangerous and erroneous operation of the treadmill; and shut-off of said treadmill.

3. A cardiac rehabilitation system having a treadmill and treadmill motor or motors which are electrically controlled; a heart rate transducer means connected to a patient; a heart rate monitor connected to said heart rate transducer means whereby the heart rate of said patient is converted to an electrical signal; a computer having means for receiving said electrical signal and sending said electrical signal to said electrically controlled treadmill and treadmill motor or motors and which allows flexible setting of prescribed exertion level or levels for rehabilitation for each patient, and which requires the patient to reach the prescribed level of exertion and remain in a target range defining the prescribed level of exertion, while at the same time being protected from dangerous or damaging exertion, so that the system automatically prevents both underexertion and overexertion, the improvement comprising:

an input/output card connected to said computer, monitor, treadmill and treadmill motor or motors whereby electrical signals from said monitor are communicated to said computer and instructions from said computer are transmitted to said treadmill and treadmill motor or motors;

the input/output card including system time base means for providing a time base for synchronization of events and for accurate measurements in the cardiac rehabilitation system; elapsed time means for timing at least a work period of an exercise program for the patient; treadmill speed feedback means operatively connected to the treadmill for monitoring and producing a signal representative of the speed of the treadmill; treadmill motor control means operatively connected to the treadmill and treadmill motor or motors for converting instructions from the computer into signals which can control on and off operation, speed, and elevation of the treadmill and operation and speed of the treadmill motor or motors;

heart rate monitor input means for converting the electrical signal from the heart rate monitor into a signal which is representative of the patient's actual heart rate and is interpretable by the computer, so that any dangerous or damaging exertion is immediately detectable and the system controlled to protect the patient; and input/output control logic means for coordinating timing and communication through the input/output card.

4. The system of claim 3 wherein said computer is mounted on supporting structure arising from said treadmill whereby said patient can see said computer while using said treadmill.

5. The system of claim 2 wherein said computer is mounted on supporting structure arising from said treadmill whereby said patient can see said computer while using said treadmill.

6. The system of claim 1 wherein said computer is mounted on supporting structure arising from said treadmill whereby said patient can see said computer while using said treadmill.

7. The system of claim 1 wherein said computer is personal computer of said patient whereby said system can be operated within the home of said patient.

8. A cardiovascular conditioning and therapeutic system which allows flexible setting of prescribed exertion level or levels for rehabilitation for a patient, and which requires the patient to reach the prescribed level of exertion and remain in a target range defining the prescribed level of exertion, while at the same time being protected from dangerous or damaging exertion, so that the system automatically prevents both underexertion and overexertion comprising:

a mechanical powered exercise means presenting a variable exercise work load to a user, which in turn tends to cause a corresponding variation in heart rate of the user;

a heart rate transducer means operatively connectable to the patient for detecting, monitoring and producing a signal corresponding to the user's heart rate;

an exercise work load transducer means operatively connectable to the exercise means for detecting and producing a signal corresponding to the current level of work load presented by the exercise means;

a control means operatively connected to the exercise means for controlling the exercise work load of the exercise means according to parameters, the parameters including at least length of time of exercise, the heart rate of the user, and a predetermined target heart rate for the user;

input means associated with the control means for entering the predetermined target heart rate to the control means so that the target heart rate is retained by the control means, and entering a length of time desired to operate the exercise means for conditioning period;

the control means being operatively adapted to receive the signals from the heart rate transducer means and exercise work load transducer means, to compare current heart rate of the user to the target heart rate, and to create and send instructions in the form of signals to the exercise means to vary the work load so that heart rate will approximately match the target heart rate;

the control means including start-up means for sending a signal to actuate the exercise means upon instruction, warm-up means to incrementally increase exercise work load to correspondingly incrementally increase the user's heart rate during a warm-up period, and including means to produce a signal to reduce exercise work load if the heart rate exceeds the target rate, conditioning means for sending a signal by continuously monitoring an increasing or decreasing exercise work load to maintain heart rate at within a predetermined margin of the target heart rate, and cool-down means for sensing a signal incrementally decreasing the work load at the end of the entered length of time of the desired conditioning period; and the control means also including verification means which recursively reads the signal corresponding to the user's heart rate, the signal corresponding to the current level of work load, the predetermined target heart rate, and length of time desired for exercise and compares user's heart rate, averaged over a plurality of recursive readings, with target heart rate, and verifies that such readings are within acceptable limits to verify accuracy of the readings, to eliminate spurious erroneous readings, and to ensure that user's heart rate cannot move outside of safe limits without detection.

9. A cardiovascular conditioning and therapeutica system which allows flexible setting of prescribed exertion level or levels for rehabilitation for a patient, and which requires the patient to reach the prescribed level of exertion and remain in a target range defining the prescribed level of exertion, while at the same time being produced from dangerous or damaging exertion, so that the system automatically prevents both underexertion and overexertion comprising:

a motorized treadmill including movable belt, elevation means for varying the angle of the belt with respect to horizontal, a first motor which varies the speed of the belt between a stop condition and a maximum speed condition, and a second motor which varies the elevation means between a minimum angle position and a high angle position, said first and second motors being operatively connected to a power source;

a heart rate transducer operationally positionable upon a user to produce a signal corresponding to the user's heart rate, said transducer being operatively associated with a display means for visually displaying current user heart rate;

a belt speed transducer operationally connected to the movable belt of the motorized treadmill to produce a signal corresponding to the rotational speed of the belt, the belt speed transducer including a switch means mounted to the treadmill, the switch means producing a count signal upon sensing moving indicia associated with movement of the treadmill belt, and compating means computing the belt's speed by timing the period between count signals;

an elevation means transducer operationally connected to the elevation means of the motorized treadmill to produce a signal corresponding to the angle of the belt with respect to horizontal, the elevation means transducer including a timer means which measures the period of time the second motor runs when actuated and correlates such period of time into an angle of elevation of the treadmill, and producing an elevation signal representing such elevation;

computer means operatively connected to the first and second motors of the treadmill and the belt speed and elevation means transducers;

user input means in said computer means which receives input, including predetermined target heart rate and length of operation of the treadmill for a conditioning period, transducer input means in said computer means which receives the signals from the heart rate transducer, belt speed transducer and elevation means transducer, for monitoring heart rate, calculating the difference between the current heart rate and target rate, and monitoring belt speed and elevation of belt of the treadmill; and instruction output means in said computing means for sending signals selectively to the first and second motors to vary speed and angle of the belt of the treadmill until heart rate approximately matches the target heart rate.

10. A method of cardiovascular conditioning and therapy which allows flexible setting of prescribed exertion level or levels for rehabilitation for a user, and which requires the user to reach the prescribed level of exertion and remain in a target range defining the prescribed level of exertion, while at the same time being protected from dangerous or damaging exertion, so that the system automatically prevents both underexertion and overexertion comprising the steps of:

positioning a user upon a mechanized powered exercise means which can present a variable exercise work load to the user which in turn causes a corresponding variation in heart rate of the user;

operatively connecting a heart rate transducer means to the user for monitoring and producing a signal corresponding to the user's heart rate;

operatively connecting an exercise work load transducer means to the exercise means for producing an electrical signal corresponding to the current level of work load of the exercise means;

continuously monitoring the heart rate of the user by recursively sampling the signal corresponding the user's heart rate over a plurality of consecutive sampling times and averaging the signals at the plurality of consecutive sampling times to ensure accuracy and to prevent spurious and random error which might occur without consecutive sampling and averaging;

determining a target heart rate for conditioning and therapeutic purposes of the user;

determining a desired conditioning period of time for the user;

actuating the exercise means to present a variable exercise work load to the user;

incrementally increasing the exercise work load to incrementally increase the user's heart rate during a warm-up period, while continuously monitoring the user's heart rate;

reducing the exercise work load if the heart rate exceeds the target rate;

repetitively comparing current user's heart rate to target heart rate, and increasing exercise work load until current user heart rate comes within a predetermined range of the target heart rate;

beginning timing of the conditioning period when the current heart rate enters the predetermined margin of the target heart rate;

increasing, decreasing or maintaining exercise work load to maintain current user heart rate within the predetermined margin of the target heart rate during the conditioning period and preventing either underexertion and overexertion;

incrementally decreasing the work load at the end of the conditioning period until current user heart rate decreases to a predetermined level; and verifying that the user's heart rate is within acceptable limits at all times during operation of the system by utilizing the recursive sampling of the signal corresponding to the user's heart rate to continuously compare the user's heart rate to the target range, and by automatically stopping the work load presented to the user if the user's heart rate substantially varies outside acceptable limits.

11. The system of claim 8 comprising a plurality of exercise means each presenting a variable execise work load to a corresponding plurality of users and, the control means comprising a central control processor means which is operatively connected to each exercise means, and to a heart rate transducer means and exercise work load transducer means for each user, the central control processor means controlling operation of each exercise means according to pre-determined and pre-sent prescribed exertion levels and target ranges for each user.

12. The system of claim 11 where the central control processor means is communicable with one or more exercise means so that any number of exercise means can be operated simultaneously.

13. The system of claim 12 where the central control processor means is communicable to remotely located exercise means.

14. The system of claim 13 wherein the central control processor means is communicable to remotely located exercise means by electrical communication through telephone lines.

* * * * *

UNITED STATES PATENT AND TRADEMARK OFFICE

CERTIFICATE OF CORRECTION

PATENT NO. : 4,860,763

DATED : August 29, 1989

INVENTOR(S) : Kevin L. Schminke

It is certified that error appears in the above—identified patent and that said Letters Patent is hereby corrected as shown below:

Column 14, line 45, change "sensing" to --sending--.

Column 14, line 60, change "therapeutica" to --therapeutic--.

Column 14, line 66, change "produced" to --protected--.

Column 15, line 22, change "compating means" to --computing means for--.

Signed and Sealed this

Fourteenth Day of August, 1990

*Attest:*

HARRY F. MANBECK, JR.

*Attesting Officer*

*Commissioner of Patents and Trademarks*